US006640492B2

(12) United States Patent
Weder

(10) Patent No.: US 6,640,492 B2
(45) **Date of Patent: *Nov. 4, 2003**

(54) FLOWER POT WRAPPER

(75) Inventor: Donald E. Weder, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/238,447

(22) Filed: Sep. 9, 2002

(65) Prior Publication Data

US 2003/0005632 A1 Jan. 9, 2003

Related U.S. Application Data

(63) Continuation of application No. 09/910,084, filed on Jul. 20, 2001, now Pat. No. 6,449,900, which is a continuation of application No. 09/465,613, filed on Dec. 17, 1999, now Pat. No. 6,321,486.

(51) Int. Cl.[7] ..... A01G 9/02
(52) U.S. Cl. ..... 47/72
(58) Field of Search ..... 47/72

(56) References Cited

U.S. PATENT DOCUMENTS

| | | | | |
|---|---|---|---|---|
| 84,207 | A | 11/1868 | Moore | 229/4.5 |
| 239,987 | A | 4/1881 | Shallenberger | |
| 580,671 | A | 4/1897 | Perry | 229/4.5 |
| 681,066 | A | 8/1901 | Millinger | |
| 716,668 | A | 12/1902 | Cheney | |
| 732,889 | A | 7/1903 | Paver | |
| 797,175 | A | 8/1905 | Collenberg | 47/72 |
| 923,663 | A | 6/1909 | Kroeger | |
| 1,002,346 | A | 9/1911 | Weeks | |
| 1,052,379 | A | 2/1913 | Ranken | |
| 1,064,813 | A | 6/1913 | Bloomberg | |
| 1,069,675 | A | 8/1913 | Claussen | |
| 1,206,708 | A | 11/1916 | Hutchins | |
| 1,293,316 | A | 2/1919 | Bogert | 229/4.5 |
| 1,421,027 | A | 6/1922 | Reynolds | |
| 1,421,628 | A | 7/1922 | Watkins | |
| 1,446,014 | A | 2/1923 | Lodge | 47/72 |
| 1,446,563 | A | 2/1923 | Hughes | |
| 1,520,647 | A | 12/1924 | Hennegan | |
| 1,610,652 | A | 12/1926 | Bouchard | |
| 1,693,435 | A | 11/1928 | Clarke | 206/45.3 |
| 1,697,751 | A | 1/1929 | Blake | 229/87 |
| 1,863,216 | A | 6/1932 | Wordingham | |
| 1,868,853 | A | 7/1932 | Sievers | |
| 1,920,533 | A | 8/1933 | Strauss | 281/34 |

(List continued on next page.)

FOREIGN PATENT DOCUMENTS

| | | |
|---|---|---|
| AT | 192843 | 11/1957 |
| AU | 4231978 | 6/1979 |
| BE | 654427 | 1/1965 |

(List continued on next page.)

OTHER PUBLICATIONS

Speed Cover Brochure, "The Simple Solution For Those Peak Volume Periods", Highland Supply Corporation, ©1989.

(List continued on next page.)

*Primary Examiner*—Charles T. Jordan
*Assistant Examiner*—Francis T. Palo
(74) *Attorney, Agent, or Firm*—Dunlap Codding & Rogers, P.C.

(57) ABSTRACT

A wrapper for flower pots. The wrapper is a sheet of material with each segment having a lower portion sized to surround a sidewall of the flower pot and an upper portion detachable from the lower portion via a detaching element such as perforations. The sheet of material can be formed about the flower pot and the adjacent edges of the segment joined and sealed.

16 Claims, 2 Drawing Sheets

U.S. PATENT DOCUMENTS

| | | | | |
|---|---|---|---|---|
| 1,924,926 | A | 8/1933 | Gray | 65/53 |
| 1,951,642 | A | 3/1934 | Augustin et al. | 47/66 |
| 1,978,631 | A | 10/1934 | Herrlinger | 91/68 |
| 1,979,771 | A | 11/1934 | Potter | 47/41 |
| 2,076,212 | A | 4/1937 | Suter et al. | 91/67.9 |
| 2,123,075 | A | 7/1938 | Langa | 47/34 |
| 2,152,648 | A | 4/1939 | Jones | 47/34 |
| 2,165,539 | A | 7/1939 | Dahlgren | 206/80 |
| 2,200,111 | A | 5/1940 | Bensel | 229/1.5 |
| 2,209,778 | A | 7/1940 | Krasowski | 41/10 |
| 2,278,673 | A | 4/1942 | Savada et al. | 154/43 |
| 2,302,259 | A | 11/1942 | Rothfuss | 41/10 |
| 2,317,554 | A | 4/1943 | Risch | 206/45.31 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,373,634 | A | 4/1945 | Wagner | 117/122 |
| 2,411,328 | A | 11/1946 | MacNab | 33/12 |
| 2,482,981 | A | 9/1949 | Kamrass | 41/13 |
| 2,510,120 | A | 6/1950 | Leander | 117/122 |
| 2,529,060 | A | 11/1950 | Trillich | 117/68.5 |
| 2,578,583 | A | 12/1951 | O'Brien | 206/65 |
| 2,612,989 | A | 10/1952 | Harrison | 206/45 |
| 2,664,670 | A | 1/1954 | Mulford | 47/37 |
| 2,688,354 | A | 9/1954 | Berger | 150/28 |
| 2,707,352 | A | 5/1955 | Fischer | 47/58 |
| 2,744,624 | A | 5/1956 | Hoogstoel et al. | 206/65 |
| 2,774,187 | A | 12/1956 | Smithers | 47/41 |
| 2,822,287 | A | 2/1958 | Avery | 117/14 |
| 2,827,217 | A | 3/1958 | Clement | 229/1.5 |
| 2,845,735 | A | 8/1958 | Werner | 41/10 |
| 2,871,080 | A | 1/1959 | Shelly | 312/107 |
| 2,925,208 | A | 2/1960 | Wood | 229/4.5 |
| 2,942,823 | A | 6/1960 | Chapman | 248/97 |
| 2,967,652 | A | 1/1961 | Canfield et al. | 229/5.5 |
| 2,989,828 | A | 6/1961 | Warp | 53/390 |
| 3,013,689 | A | 12/1961 | Shropshire | 215/100.5 |
| 3,022,605 | A | 2/1962 | Reynolds | 47/58 |
| 3,080,680 | A | 3/1963 | Reynolds | 47/37 |
| 3,094,810 | A | 6/1963 | Kalpin | 47/37 |
| 3,113,673 | A | 12/1963 | Stein | 206/65 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,389,784 | A | 6/1968 | Hendricks et al. | 206/47 |
| 3,431,706 | A | 3/1969 | Stuck | 53/390 |
| 3,488,022 | A | 1/1970 | Vittori | 248/152 |
| 3,508,372 | A | 4/1970 | Wallerstein et al. | 53/3 |
| 3,512,700 | A | 5/1970 | Evans et al. | 229/53 |
| 3,513,895 | A | 5/1970 | Lattuca | 150/48 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,620,366 | A | 11/1971 | Parkinson | 206/59 C |
| 3,657,840 | A | 4/1972 | Benoist | 47/41 |
| 3,681,105 | A | 8/1972 | Milutin et al. | 117/15 |
| 3,734,280 | A | 5/1973 | Amneus et al. | 206/65 |
| 3,767,104 | A | 10/1973 | Bachman et al. | 229/7 |
| 3,775,903 | A | 12/1973 | Pike | 47/37 |
| 3,869,828 | A | 3/1975 | Matsumoto | 47/84 |
| 3,883,990 | A | 5/1975 | Stidolph | 47/58 |
| 3,910,328 | A | 10/1975 | Marcoux | 150/52 |
| 3,924,354 | A | 12/1975 | Gregoire | 47/34.11 |
| 3,962,503 | A | 6/1976 | Crawford | 428/40 |
| 3,974,960 | A | 8/1976 | Mitchell | 229/62 |
| 4,043,077 | A | 8/1977 | Stonehocker | 47/66 |
| 4,053,049 | A | 10/1977 | Beauvais | 206/318 |
| 4,054,697 | A | 10/1977 | Reed et al. | 428/40 |
| 4,091,925 | A | 5/1978 | Griffo et al. | 206/423 |
| 4,118,890 | A | 10/1978 | Shore | 47/28 |
| 4,124,160 | A | 11/1978 | Meyers et al. | 229/21 |
| 4,170,618 | A | 10/1979 | Adams | 264/101 |
| 4,189,868 | A | 2/1980 | Tymchuck et al. | 47/84 |
| D254,659 | S | 4/1980 | Karotseris | D11/143 |
| 4,216,620 | A | 8/1980 | Weder et al. | 47/72 |
| 4,248,347 | A | 2/1981 | Trimbee | 206/423 |
| 4,250,664 | A | 2/1981 | Remke | 47/76 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,283,032 | A | 8/1981 | Smith | 248/97 |
| 4,297,811 | A | 11/1981 | Weder | 47/72 |
| 4,300,312 | A | 11/1981 | Weder et al. | 47/72 |
| 4,333,267 | A | 6/1982 | Witte | 47/84 |
| 4,338,979 | A | 7/1982 | Dow | 141/10 |
| 4,340,146 | A | 7/1982 | Stratton | 215/100.5 |
| 4,347,686 | A | 9/1982 | Wood | 47/73 |
| 4,380,564 | A | 4/1983 | Cancio et al. | 428/167 |
| 4,396,120 | A | 8/1983 | Morita | 206/460 |
| 4,400,910 | A | 8/1983 | Koudstall et al. | 47/84 |
| 4,413,725 | A | 11/1983 | Bruno et al. | 206/45.33 |
| 4,470,508 | A | 9/1984 | Yen | 206/334 |
| 4,488,697 | A | 12/1984 | Garvey | 248/101 |
| 4,508,223 | A | 4/1985 | Catrambone | 206/423 |
| D279,279 | S | 6/1985 | Wagner | D11/143 |
| 4,608,283 | A | 8/1986 | White | 428/4 |
| 4,621,733 | A | 11/1986 | Harris | 206/423 |
| 4,640,079 | A | 2/1987 | Stuck | 53/390 |
| 4,646,470 | A | 3/1987 | Maggio | 47/76 |
| D292,562 | S | 11/1987 | Weder et al. | D11/164 |
| D292,563 | S | 11/1987 | Weder et al. | D11/164 |
| D293,224 | S | 12/1987 | Weder et al. | D11/164 |
| D293,774 | S | 1/1988 | Weder et al. | D11/164 |
| D293,775 | S | 1/1988 | Weder et al. | D11/164 |
| 4,717,262 | A | 1/1988 | Roen et al. | 383/120 |
| 4,733,521 | A | 3/1988 | Weder et al. | 53/580 |
| 4,741,440 | A | 5/1988 | Harris | 206/423 |
| 4,773,182 | A | 9/1988 | Weder et al. | 47/72 |
| 4,795,601 | A | 1/1989 | Cheng | 264/138 |
| 4,801,014 | A | 1/1989 | Meadows | 206/423 |
| 4,819,803 | A | 4/1989 | Neiser | 206/423 |
| 4,835,834 | A | 6/1989 | Weder | 29/525 |
| D301,991 | S | 7/1989 | Van Sant | D11/149 |
| 4,882,893 | A | 11/1989 | Spencer et al. | 53/449 |
| 4,980,209 | A | 12/1990 | Hill | 428/34.1 |
| 5,018,300 | A | 5/1991 | Chiu et al. | 47/67 |
| 5,073,161 | A | 12/1991 | Weder et al. | 493/154 |
| 5,076,011 | A | 12/1991 | Stehouwer | 47/72 |
| 5,077,937 | A | 1/1992 | Weder et al. | 47/72 |
| 5,085,003 | A | 2/1992 | Garcia | 47/72 |
| 5,092,465 | A | 3/1992 | Weder et al. | 206/423 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,148,918 | A | 9/1992 | Weder et al. | 206/423 |
| 5,152,100 | A | 10/1992 | Weder et al. | 47/72 |
| 5,181,364 | A | 1/1993 | Weder | 53/397 |
| 5,195,637 | A | 3/1993 | Weder | 206/423 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Landau | 47/72 |
| 5,240,109 | A | 8/1993 | Weder et al. | 206/423 |
| 5,249,407 | A | 10/1993 | Stuck | 53/399 |
| 5,255,784 | A | 10/1993 | Weder et al. | 206/423 |
| 5,259,106 | A | 11/1993 | Weder et al. | 29/469.5 |
| 5,265,727 | A | 11/1993 | Anderson | |

| | | | | |
|---|---|---|---|---|
| 5,297,359 | A | 3/1994 | Garcia | 47/58 |
| 5,307,606 | A | 5/1994 | Weder | 53/410 |
| 5,311,992 | A | 5/1994 | Weder et al. | 206/423 |
| 5,315,785 | A | 5/1994 | Avôt et al. | 47/72 |
| 5,332,610 | A | 7/1994 | Weder | 428/99 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,402,601 | A | 4/1995 | Garcia | 47/72 |
| 5,407,072 | A | 4/1995 | Weder et al. | 206/423 |
| 5,411,137 | A | 5/1995 | Weder et al. | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,564,567 | A | 10/1996 | Weder | 206/423 |
| 5,572,849 | A | 11/1996 | Weder et al. | 53/399 |
| 5,572,851 | A | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,634,558 | A | 6/1997 | Weder | 206/423 |
| 5,647,168 | A | 7/1997 | Gilbert | 47/72 |
| 5,836,447 | A | 11/1998 | Garcia et al. | 206/423 |
| 6,131,332 | A | 10/2000 | Garcia | 47/72 |
| 6,321,486 | B1 * | 11/2001 | Weder | 47/72 |
| 6,449,900 | B1 * | 9/2002 | Weder | 47/72 |

FOREIGN PATENT DOCUMENTS

| | | |
|---|---|---|
| CH | 161005 | 3/1941 |
| CH | 560532 | 4/1975 |
| CH | 274167 | 10/1983 |
| DE | 345464 | 12/1921 |
| DE | 513971 | 11/1930 |
| DE | 1166692 | 3/1964 |
| DE | 2948265 | 4/1966 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 8905250 | 10/1989 |
| DE | 3911847 | 10/1990 |
| EP | 0050990 | 5/1982 |
| EP | 0791543 | 8/1997 |
| FR | 1144102 | 1/1955 |
| FR | 1376047 | 9/1964 |
| FR | 1393725 | 2/1965 |
| FR | 2036163 | 12/1970 |
| FR | 2137325 | 12/1972 |
| FR | 2221936 | 10/1974 |
| FR | 2272914 | 12/1975 |
| FR | 2467796 | 11/1979 |
| FR | 2489126 | 3/1982 |
| FR | 433587 | 7/1985 |
| FR | 2610604 | 8/1988 |
| FR | 2603159 | 3/1989 |
| FR | 2619698 | 3/1989 |
| GB | 5605 | 5/1885 |
| GB | 26878 | of 1913 |
| GB | 1204647 | 9/1970 |
| GB | 891078 | 5/1975 |
| GB | 28130 | 1/1977 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 4352664 | 12/1992 |
| JP | 542958 | 2/1993 |
| NL | 8101464 | 9/1945 |
| NL | 8301709 | 12/1984 |
| NL | 1000658 | 1/1996 |
| WO | 9315979 | 8/1993 |

OTHER PUBLICATIONS

"Speed Sheets and Speed Rolls" Brochure, Highland Supply Corporation, ©1990.

"Color Them Happy with Highlander Products" ©1992.

"Costa Keeps the Christmas Spirit", Supermarket Floral, Sep. 15, 1992.

"Super Seller", Supermarket Floral, Sep. 15, 1992.

"Halloween", Link Magazine, Sep. 1992, 2 pages.

"Now More Than Ever", Supermarket Floral, Sep. 15, 1992.

Le Plant Sac Advertisement, published prior to Sep. 26, 1987.

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

* cited by examiner

FLOWER POT WRAPPER

CROSS-REFERENCE TO RELATED APPLICATIONS

This application is a continuation of U.S. Ser. No. 09/910,084, filed Jul. 20, 2001, entitled "PLANT WRAPPER," now U.S. Pat. No. 6,449,900; which is a continuation of U.S. Ser. No. 09/465,613, filed Dec. 17, 1999, entitled "PLANT WRAPPER," now U.S. Pat. No. 6,321,486, both of which are hereby expressly incorporated herein in their entirety by reference.

STATEMENT REGARDING FEDERALLY SPONSORED RESEARCH OR DEVELOPMENT

Not Applicable

BACKGROUND

This invention relates generally to flower pot wrappers and methods of their use.

BRIEF DESCRIPTION OF THE INVENTION

A wrapper for a pot formed of a segmented sheet with each segment having a lower portion sized to surround a sidewall of the pot and an upper portion detachable from the lower portion via a detaching element such as perforations. The segmented sheet can be formed about the pot and the adjacent edges of the segments joined and sealed.

DETAILED DESCRIPTION OF THE INVENTION

Figure 1:
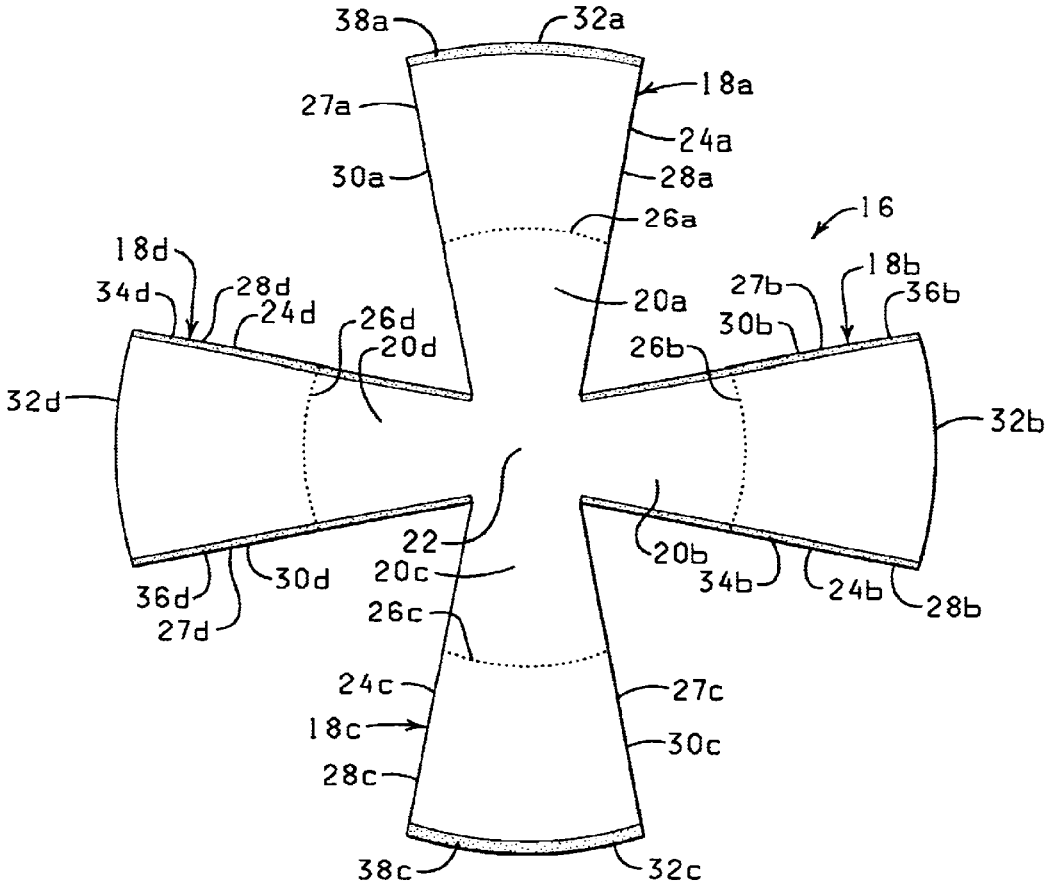
FIG. 1 is a top plan view of a sheet of material for forming a wrapper for a flower pot constructed in accordance with the present invention.

Referring now more particularly to the drawings, and to those embodiments of the invention here presented by way of illustration, FIG. 1 shows a segmented sheet of material (also referred to herein as segmented sheet or sheet of material) designated by reference numeral 16 to be utilized to form a wrapper 20 for a pot (designated below as pot 40). As shown herein, it is contemplated that the sheet of material 16 might be substantially circular, and might further include a printed design. Furthermore, the sheet of material 16 will generally be a relatively flexible material, for example, a paper or a polyethylene film or paper polyethylene laminate or other polymeric film described in more detail below. Moreover, polyethylene is mentioned only by way of example, and it will be readily understood by those skilled in the art that polypropylenes, polyethers, various vinyls and the like can be used equally well. While printability of the material is desirable, it will be understood that the sheet of material 16 can be solid white and/or of a translucent nature, or can be colored, either as a solid color or a marbleized, moiree or swirled pattern. In one embodiment, not show herein, but similar to that shown in U.S. Pat. No. 5,402,601, the specification of which is hereby expressly incorporated herein by reference in its entirety, both to place the sheet of material 16 and to retain the sheet of material 16 about the pot 40, a frustoconial sleeve (not shown) may be provided and placed about the segmented sheet 16 when disposed about the pot 40. The sleeve, when used, is sized to receive the pot 40 and retain the sheet of material 16 in place about the pot 40.

While the sheet of material 16 is illustrated as having segments with arcuate ends, it will be readily noted that virtually any other shape of material can be used, the primary requirement being to have the sheet of material 16 large enough to cover the pot 40 and to have upper detachable portions extending therefrom to surround a plant disposed in the pot 40.

The sheet of material 16 has a common central base portion 22 which corresponds approximately to the size and shape of a bottom 42 of the flower pot 40. It should be noted that the central base portion 22 can be any shape such as square, rectangle, polygon or any other shape to conform to the size and shape of the bottom 42 of the flower pot 40 on which the wrapper 20 made from the sheet of material 16 is to be used.

The sheet of material 16 shown in FIG. 1 has four segments. The four segments are designated by the respective numerals 18*a*, 18*b*, 18*c* and 18*d*. Although the sheet of material 16 is shown herein as having four segments, the sheet of material 16 may have two, three, five or more segments in a manner similar to the four-segmented sheet of material 16 shown herein. Each of the segments 18*a*–18*d* is generally trapezoidal shaped and the segments 18*a*–18*d* are joined at the central base portion 22 sized to fit the bottom 42 of the pot 40. Each segment 18*a*–18*d* has a lower portion, 20*a*–20*d*, respectively, and an upper portion 24*a*–24*d*, respectively. Each segment 18*a*–18*d* has a detaching element, such as a line of perforations 26*a*–26*d*, respectively, for enabling the detachment of each upper portion 24*a*–24*d* from each lower portion 20*a*–20*d*, respectively. Although each line of perforations 26*a*–26*d* is shown as an arcuate line across each segment 18*a*–18*d*, the present invention contemplates that each line of perforations 26*a*–26*d* (or other detaching elements) may have a different pattern, for example straight, wavy, zig-zag, crenulate, scalloped, sine wave, irregular, or other fanciful or decorative patterns. See for example FIGS. 11–16 of U.S. Ser. No. 08/606,957, the specification of which is hereby expressly incorporated herein by reference. Generally, triangularly shaped notchs or spaces 27*a*–27*d* are formed between each pair of adjacent segments 18*a*–18*d* so that a side 28*a*–28*d* of each of the segments 18*a*–18*d* is spaced opposite to a side 30*a*–30*d* of each adjacent segment 18*a*–18*d*. For example, side 28*a* is opposite side 30*b*, side 28*b* is opposite side 30*c*, side 28*c* is opposite side 30*d*, and side 28*d* is opposite side 30*a*. Each segment 18*a*–18*d* also has an end 32*a*–32*d*, (also referred to herein as upper ends 32*a*–32*d*) respectively on each upper portion 24*a*–24*d*.

Figure 2:
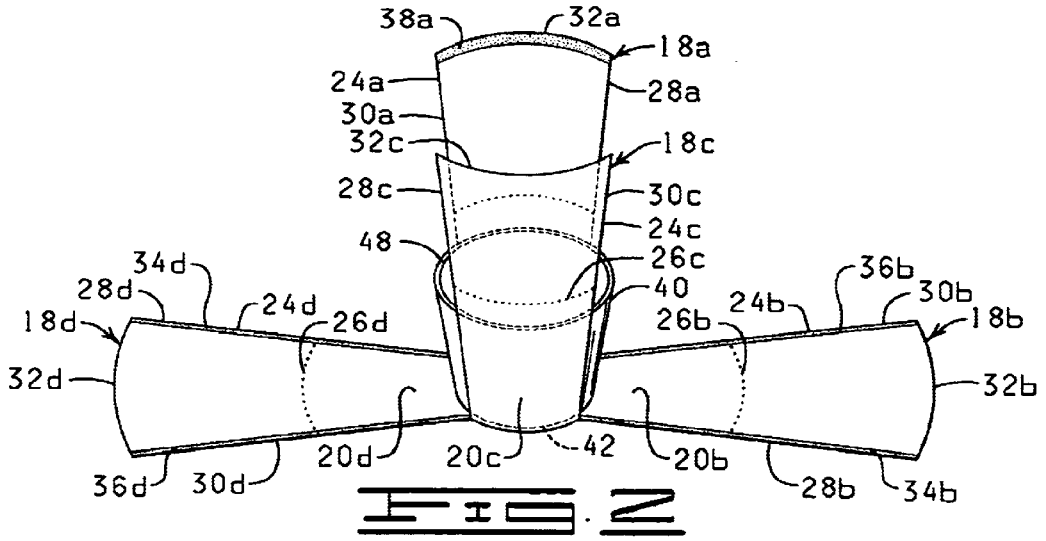
FIG. 2 is a perspective view of the sheet of material of FIG. 1 partially formed about the flower pot.
Figure 3:
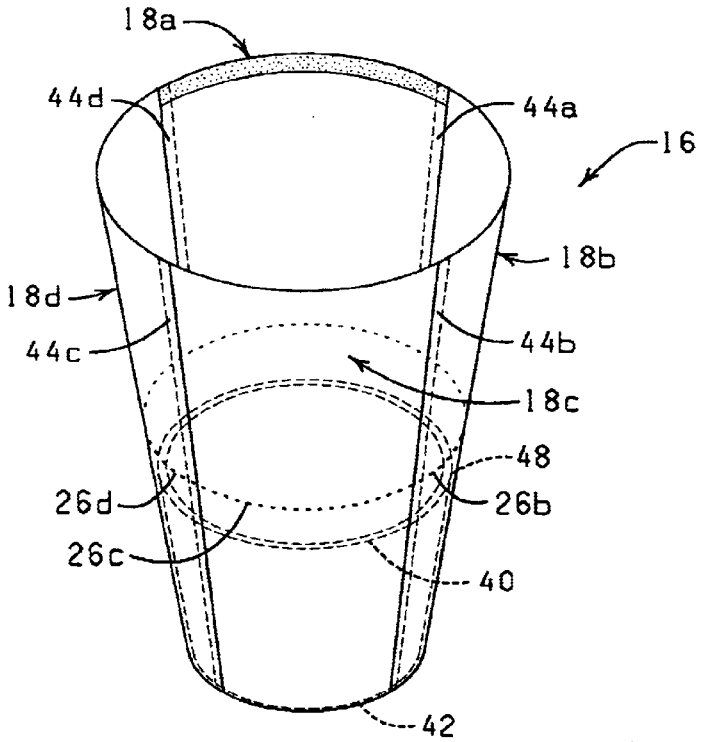
FIG. 3 is a perspective view of a wrapper for a flower pot, formed from the sheet of material of FIG. 1, segments of the wrapper being joined along their sides.

In use, the sheet of material 16 is formed about the pot 40 as shown, in FIG. 2 to form wrapper 20 shown in FIG. 3. The segments 18*a*–18*d* are shaped and sized so that when the segments 18*a*–18*d* are folded upwardly from the central base portion 22 about the pot 40, a portion of the side 28*a*–28*d* of each of the segments 18*a*–18*d* generally overlaps a portion of the adjacent side 30*b*–30*a*, respectively. When formed about the pot 40, the notches 27*a*–27*d* between segments 18*a*–18*d* provide sufficient relief so that the sheet of material 16 will not be appreciably pleated. During the process of forming the sheet of material 16 about the pot 40, the segments 18*a*–18*d* will be urged upwardly and the opposite adjacent sides 28*a*–28*d* and 30*a*–30*d* of adjacent segments 18*a*–18*d* will be slightly overlapped. The entire outer peripheral surface of the pot 40 will be covered by the sheet of material 16 with the central base portion 22 covering the bottom 42 of the flower pot 40 and the lower portions 20*a*–20*d* of the segments 18*a*–18*d* covering a sidewall of the pot 40, and the upper portions 24*a*–24*d* of the segments 18*a*–18*d* extending upwardly beyond an upper rim 48 of the flower pot 40.

It will therefore be understood by those skilled in the art that a quite different appearance can be achieved on the pot 40 since various papers, heavy plastics, metalized papers, or plastics can be utilized, and even a heavy foil can be utilized, to speed of assembly of the wrapper.

In order to enhance the sealing of sides 28*a*–28*d* to sides 30*b*–30*a*, respectively, a bonding material may optionally be disposed along opposing edges of the segments 18*a*–18*d*. For example as shown in FIG. 1, segment 18*b* has bonding materials 34*b* and 36*b* disposed along sides 28*b* and 30*b*, respectively. Similarly, segment 18*d* has bonding materials 34*d* and 36*d* disposed along sides 28*d* and 30*d*, respectively. These areas of bonding material enhance the connection between opposite and adjacent sides of pairs of segments 18*a*–18*d*.

For example, as shown in FIGS. 2 and 3, overlapping sides 28*b* and 30*c* of segments 18*b* and 18*c*, respectively, are sealed along a bonding material 34*b* on segment 18*b* to form a flat joint seal 44*b*. Overlapping sides 28*c* and 30*d* of segments 18*c* and 18*d*, respectively, are sealed along a bonding material 36*d* on segment 18*d* to form a flat joint seal 44*c*. Overlapping sides 28*d* and 30*a* on segments 18*d* and 18*a*, respectively, are sealed along a bonding material 34*d* on segment 18*d* to form a flat joint seal 44*d*. Overlapping sides 28*a* and 30*b* on segments 18*a* and 18*b*, respectively, are sealed along a bonding material 36*b* on segment 18*b* to form a flat joint seal 44*a*.

As noted above bonding materials 34*b* and 34*d* and 36*b* and 36*d* are not required if sealing of the joints 44*a*–*d* may be accomplished in another manner, for example by heat sealing, sonic sealing or vibratory sealing.

Bonding materials 38*a* and 38*c* are shown as disposed along upper ends 32*a* and 32*c* of the segments 18*a*–18*d* respectively, for the purpose of closing the upper ends 32*a*–32*d* of the sheet of material 16 after the wrapper 20 has been formed about the pot 40. Bonding materials may also be disposed along ends 32*b* and 32*d*.

Any thickness of material may be utilized as long as the material functions in accordance with the present invention, as long as the sheet of material 16 may be formed as described herein, and as long as the formed sheet of material 16 may contain at least a portion of a pot or potted plant or a floral grouping and medium, as described herein. Typically, the material from which the sheet of material 16 is constructed generally has a thickness in a range from about 0.1 mil to about 30 mils. Preferably, the sheet of material 16 has a thickness in a range from about 1.0 mil to about 5 mils.

The sheet of material 16 is constructed from a material which is flexible, semi-rigid, rigid, or any combination thereof. The sheet of material 16 may be constructed of a single layer of material or a plurality of layers of the same or different types of materials. The layers of material of the sheet of material 16 may be connected together or laminated or may be separate layers. Such materials used to construct the sheet of material 16 are described in U.S. Pat. No. 5,111,637 entitled "Method For Wrapping a Floral Grouping" issued to Weder et al., on May 12, 1992, which is hereby expressly incorporated herein by reference. One or more layers of insulating material such as bubble film can also be disposed on a portion of the sheet of material 16 in order to provide additional protection for the item, such as the floral grouping, contained therein.

In one embodiment, the sheet of material 16 may be constructed from two polypropylene films. The two polypropylene films may be connected together or laminated or may be separate layers. In an alternative embodiment, the sheet of material 16 may be constructed from only one of the polypropylene films.

The sheet of material 16 can be constructed from any suitable material that is capable of being formed into a wrapper about a pot and a floral grouping disposed therein such as paper (untreated or treated in any manner), metal foil, polymeric film, non-polymer film, fabric (woven or nonwoven or synthetic or natural), cardboard, fiber, cloth, burlap, or laminations or combinations thereof.

The term "polymeric film" means a man-made polymer such as a polypropylene or a naturally occurring polymer such as cellophane. A polymeric film is relatively strong and not as subject to tearing (substantially non-tearable), as might be the case with paper or foil.

The sheet of material 16 may vary in color and may consist of designs or decorative patterns which are printed, etched, and/or embossed thereon using inks or other printing materials. An example of an ink which may be applied to the surface of the material is described in U.S. Pat. No. 5,147,706 entitled "Water Based Ink On Foil And/Or Synthetic Organic Polymer" issued to Kingman on Sep. 15, 1992 and which is hereby incorporated herein by reference.

In addition, the material, or portions of the material, may have various colorings, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material comprising the sheet of material 16. The material utilized for the sheet of material 16 itself may be opaque, translucent, transparent, or partially clear or tinted transparent.

It will generally be desired to use the sheet of material 16 as the wrapper 20 for the pot 40 having a plant disposed therein. The pot 40 preferably contains a plant. The term "pot" as used herein refers to any type of container used for holding a floral grouping or plant. Examples of pots, used in accordance with the present invention include, but not by way of limitation, clay pots, wooden pots, plastic pots, pots made from natural and/or synthetic fibers, or any combination thereof. The pot 40 is adapted to receive a floral grouping in a retaining space thereof. The floral grouping may be disposed within the retaining space of the pot 40 along with a suitable growing medium described in further detail below, or other retaining medium, such as a floral foam. It will also be understood that the floral grouping and any appropriate growing medium or other retaining medium, may be disposed in the pot 40.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping generally comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In accordance with the present invention, a bonding material may be disposed on a portion of the sheet of material 16 to assist in holding the sheet of material 16 to the pot 40. Furthermore, the term "detaching element" as used generally herein, means any element or combination of elements, or features, such as, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching elements" known in the art, or any combination thereof, could be substituted therefore and/or used therewith. Other examples of perforation patterns which may be used herein are shown in FIGS. 26–31 in U.S. Pat. No. 5,493,809, the specification of which is expressly incorporated herein by reference in its entirety.

In one embodiment, the lower portion 20*a*–20*d* of each segment 18*a*–18*d* of the sheet of material 16 further comprises a skirt portion which extends above the pot 40 after the upper portions 24*a*–24*d* of the segments 18*a*–18*d* are detached.

The present invention provides a quick and easy flower pot cover/wrap system that can be used with inexpensive sheets of materials for decoration. The sheet of material 16 can be printed with various designs, or be a solid color, and can even be transparent if such an effect is desired. Through the use of an outer floral sleeve, installation of the sheet of material 16 will take only a few seconds to completely cover the pot 40 without forming joint seals.

The sheet of material 16 may be formed about the pot 40 by hand or by using a forming apparatus as shown in U.S. Pat. No. 5,402,601. For example, a sheet of material 16 may be positioned generally above a female mold having a mold opening in a position wherein the central base portion 22 of the sheet of material 16 is positioned generally over the female mold opening and the segments 18*a*–18*d* each extend outwardly therefrom. A male die is connected to a cylinder rod of a hydraulic cylinder. The male die is shaped to be matingly disposed in the female mold.

In operation, the hydraulic cylinder is actuated to move the male die in the downward direction to a position wherein the lower end of the male die engages the central base portion 22 of the sheet of material 16. The male die further is moved in the downward direction pushing the central base portion 22 and the segments 18*a*–18*d* connected thereto into the female mold. As the sheet of material 16 is pushed into the female mold the segments 18*a*–18*d* are formed in an upward direction extending generally upwardly from the central base portion 22. As mentioned before, the segments 18*a*–18*d* are shaped so that when the segments 18*a*–18*d* have been moved in the upward direction and the male die is matingly disposed in the female mold, a portion of the segments 18*a*–18*d* overlaps an adjacent portion of the adjacent segment 18*a*–18*d*. The sides of each of the segments 18*a*–18*d* are connected to form the wrapper as shown above. The overlapping sides 28*a*–28*d* and 30*a*–30*d*, respectively, may be sealingly connected by heat sealing (without a bonding material) when the cover is formed from a heat sealable material such as polypropylene. In other instances, it may be necessary as shown to connect the overlapping sides by adhesively or cohesively connecting the overlapping portion of the sides of each of the segments 18*a*–18*d*.

Figure 4:
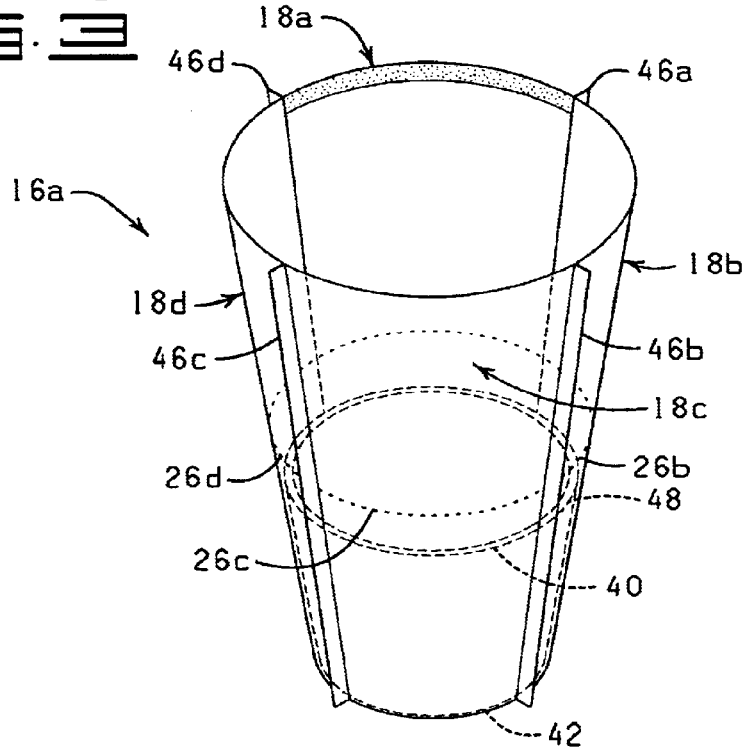
FIG. 4 is a perspective view of a wrapper for a flower pot, the wrapper having fin joints along the segments of the wrapper.

Shown in FIG. 4 is an alternate type of seal, a fin joint seal 46*a*–46*d* which may be formed rather that the flat joint seal 44*a*–44*d*, either manually, or using an apparatus such as a pair of dies in a manner known to those of ordinary skill in the art, for example as shown in U.S. Pat. No. 5,523,046 hereby expressly incorporated herein by reference.

Changes may be made in the construction and the operation of the various components, elements and assemblies described herein or in the steps or the sequence of steps of the methods described herein without departing from the spirit and scope of the invention as defined in the following claims.

What is claimed is:

1. A wrapper for a flower pot, the wrapper comprising:

a sheet of material having a central base portion and at least two segments extending away from the central base portion, each of the at least two segments having a lower portion, an upper portion, a first side, a second side, an upper end, and a detaching element disposed between the upper portion and the lower portion, for detaching the upper portion from the lower portion, the central base portion being substantially sized and shaped so as to conform to a bottom end of a flower pot and the at least two segments being sized and shaped such that as the bottom end of the flower pot is disposed adjacent the central base portion of the sheet of material and the at least two segments are formed upwardly so as to be disposed substantially adjacent a sidewall of the flower pot the at least two segments overlap and engage to form at least one overlapping portion such that at least a portion of the flower pot is covered by the lower portions of the at least two segments, and the upper portions of the at least two segments extend a distance upwardly above the flower pot and thereby form a wrapper for the flower pot.

2. The wrapper of claim 1, wherein the detaching element is a line of perforations.

3. The wrapper of claim 1, further comprising a bonding material disposed upon a portion of the at least two segments for bondingly sealing the at least one overlapping portions.

4. The wrapper of claim 1, further comprising a bonding material disposed upon the upper end of the at least two segments for bondingly connecting the upper end of the at least two segments.

5. The wrapper of claim 2, wherein the line of perforations is selected from the group consisting of arcuate, wavy, irregular, sinusoidal, toothed, zig-zagged, and otherwise non-linear, and straight, and combinations thereof.

6. The wrapper of claim 1, having four segments.

7. A method of wrapping a flower pot, comprising the steps of:

providing a sheet of material having a central base portion and at least two segments extending away from the central base portion, each segment having a first side, a second side, an upper end, an upper portion, a lower portion, and a detaching element disposed between the upper portion and the lower portion, the upper portion being removable from the lower portion via the detaching element; and forming the at least two segments of the sheet of material about a flower pot such that each of the at least two segments overlap forming at least one overlapping portion and the flower pot is covered by the lower portion of the at least two segments and the upper portion of the at least two segments extends a distance above an upper end of the flower pot.

8. The method of claim 7, wherein a seal is formed between the at least one overlapping portion.

9. The method of claim 8, wherein the seal is formed by joining the at least one overlapping portion via a bonding material disposed on at least a portion of the at least two segments.

10. The method of claim 8, wherein the seal is formed by heat sealing.

11. The method of claim 7, wherein the detaching element is a line of perforations.

12. The method of claim 11, wherein the line of perforations is selected from the group consisting of lines of perforation, the group of lines of perforations consisting of arcuate, wavy, irregular, sinusoidal, toothed, zig-zagged, and otherwise non-linear, and straight, and combinations thereof.

13. The method of claim 7, having three segments.

14. The method of claim 7, having four segments.

15. The method of claim 7, wherein the sheet of material is manually formed about the flower pot.

16. The method of claim 7, wherein the sheet of material is automatically formed about the flower pot.

* * * * *